United States Patent [19]

Murray et al.

[11] 4,022,235

[45] May 10, 1977

[54] LIQUID DISPENSING NOZZLE HAVING A FLEXIBLE RETAINING ARRANGEMENT

[75] Inventors: Robert L. Murray, Dayton, Ky.; Donald L. Leininger; Charles L. Polson, both of Cincinnati, Ohio

[73] Assignee: Dover Corporation, New York, N.Y.

[22] Filed: Feb. 13, 1976

[21] Appl. No.: 658,022

[52] U.S. Cl. ..... 137/38; 141/208; 251/108

[51] Int. Cl.[2] ..... B67D 5/371

[58] Field of Search ..... 137/38; 141/208, 218; 251/108

[56] References Cited

UNITED STATES PATENTS

| | | | |
|---|---|---|---|
| 3,653,415 | 4/1972 | Boudot et al. | 141/208 |
| 3,817,285 | 6/1974 | Wilder et al. | 141/206 X |

*Primary Examiner*—Robert G. Nilson
*Attorney, Agent, or Firm*—John G. Schenk

[57] ABSTRACT

A liquid dispensing nozzle of the automatic shut-off type has the trigger, which holds the valve actuating means in an open position, or its retaining means formed to flex when subjected to a force beyond that exerted by the valve actuating means when it is in any set flow position so that the trigger is automatically released from its retaining means if the nozzle should be accidentally removed from the fill pipe, for example.

16 Claims, 15 Drawing Figures

LIQUID DISPENSING NOZZLE HAVING A FLEXIBLE RETAINING ARRANGEMENT

In a liquid dispensing nozzle of the automatic shut-off type such as that shown and described in U.S. Pat. No. 3,817,285 to Paul R. Wilder et. al., the valve actuating means is held in an open position by a trigger cooperating with retaining means supported on a guard of the nozzle body. Because of the line of action of force along the trigger to the retaining means from the valve actuating means, there are instances in which the trigger fails to be released from the retaining means on the guard if the spout of the nozzle falls out of a fill pipe of a vehicle tank being filled, for example. As a result, there is loss of gasoline and the danger produced by the presence of the gasoline.

To enable the trigger to hold the valve actuating means in the desired open position so that various rates of flow through the nozzle body can occur, it is necessary that the trigger have a positive engagement with the retaining means. However, it is this positive engagement by the end of the trigger with the retaining means that creates a force in some instances that causes the trigger to continue to engage the retaining means to hold the valve actuating means open when the nozzle body falls out of the fill pipe of the vehicle tank being filled and strikes the ground, for example.

This problem primarily occurs when the nozzle body includes a vapor recovery arrangement so that the nozzle body has two different hoses, one for supplying liquid and one for recovering vapor, connected thereto. As a result, the force produced by the nozzle body striking the ground may not be sufficient to overcome the engaging force of the trigger with the retaining means.

The present invention satisfactorily overcomes the foregoing problem through providing a trigger capable of retaining the valve actuating means in its various open positions in accordance with the desired rate of flow but also capable of being released from the retaining means whenever the nozzle body ceases to be engaged in the fill pipe and falls to the ground, for example, so as to cause a striking blow to the nozzle body. The force of the nozzle body striking the ground causes the trigger of the present invention to be released from the retaining means rather than increasing the force of engagement between the trigger and the retaining means as occurs in various instances with the presently available triggers.

The present invention accomplishes the foregoing through providing a trigger of retaining means having at least a portion thereof flexible. As the force on the trigger from the valve actuating means increases, the trigger or the retaining means flexes more.

Accordingly, when an increased force beyond that to hold the valve actuating means in any set flow position is produced by the nozzle body striking the ground, for example, this increased force causes additional flexing of the trigger or the retaining means of the present invention sufficient to decrease the friction between the trigger and the retaining means so that the end of the trigger does not remain in engagement with the retaining means after the nozzle body bounces from the ground so that the elements of the nozzle body are no longer jammed together. This additional flexing of the trigger or the retaining means absorbs the energy of impact and utilizes it to insure that the end of the trigger does not remain in engagement with the retaining means after the elements are no longer in a jammed position because the nozzle body has bounced from the ground. Thus, the trigger of the present invention ceases to hold the valve actuating means in its open position when the spout falls out of the fill pipe of a vehicle being filled and strikes the ground, for example.

An object of this invention is to provide an improved retaining arrangement for a liquid dispensing nozzle.

Another object of this invention is to provide a liquid dispensing nozzle having a trigger capable of being released from its retaining means when subjected to a force beyond a predetermined amount.

Other objects, uses, and advantages of this invention are apparent upon a reading of this description, which proceeds with reference to the drawings forming part thereof and wherein.

Figure 1:
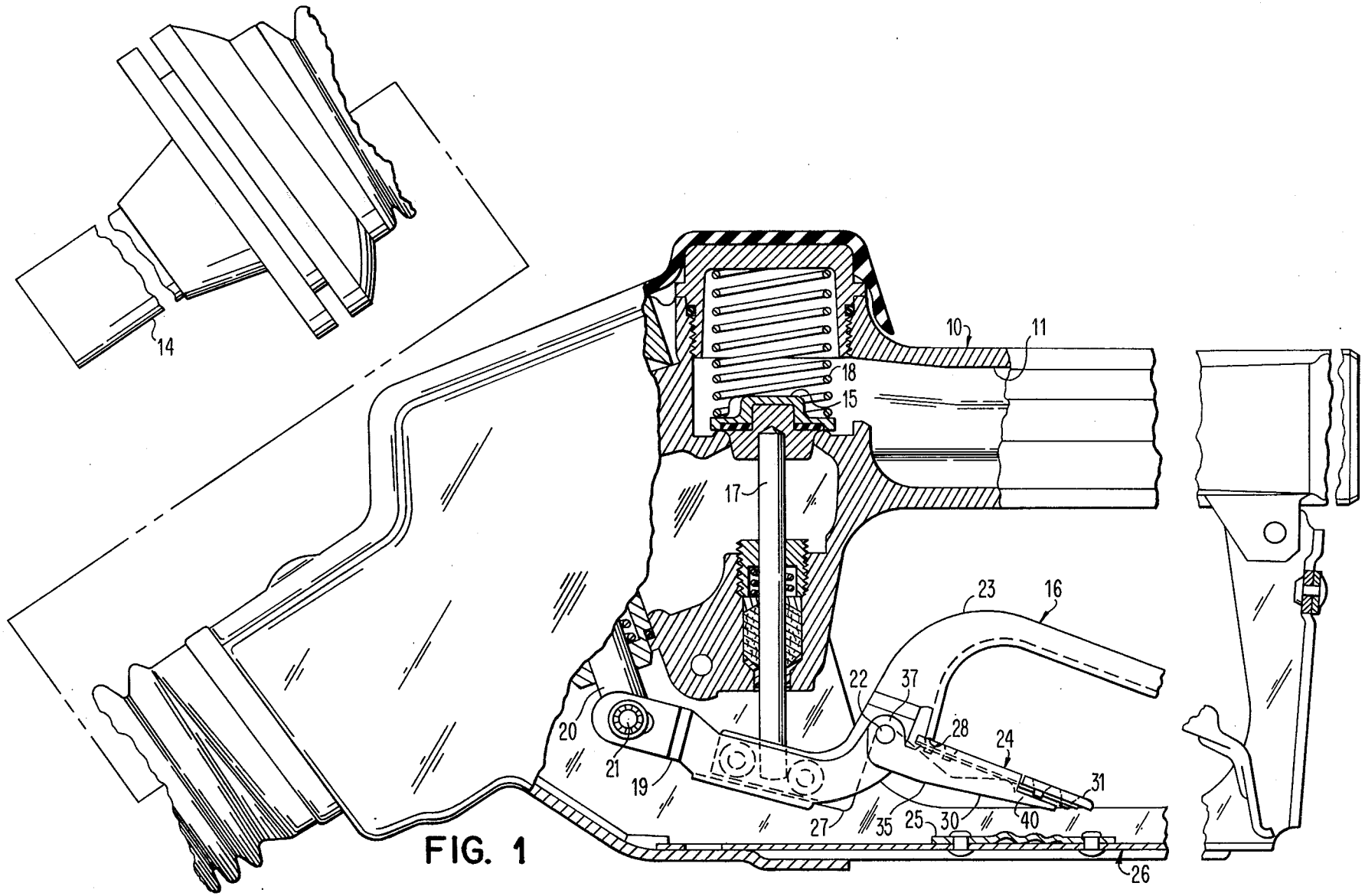
FIG. 1 is an elevational view, partly in section, of a nozzle having one form of the trigger of the present invention.

Referring to the drawings and particularly FIG. 1, there is shown a liquid dispensing nozzle of the type more particularly shown and described in U.S. Pat. No. 3,823,752 to Lasater et al. The liquid dispensing nozzle body 10 having a inlet 11 to which a hose is connected to supply a liquid such as gasoline, for example, to the interior of the body 10. The body 10 has an outlet with which a spout 14 communicates to receive liquid from the interior of the body 10.

As specifically shown and described in the aforesaid Lasater et al patent, the body 10 has a first or main poppet valve 15, which is controlled by a manually operated handle 16, and a second poppet valve (not shown) within the body 10 and spaced from the first poppet valve 15 in the direction of flow of the liquid through the body 10. The main poppet valve 15 in conjunction with the second poppet valve controls the flow to the spout 14.

The handle 16, which is of the type shown and described in the aforesaid Wilder et al. patent, moves the poppet valve 15 to its open position through a stem 17 and against the force of a spring 18, which is disposed within the body 10 and urges the poppet valve 15 to its closed position. The handle 16 has its lower lever 19 engaging the bottom of the stem 17 as more particularly shown and described in the aforesaid Wilder et al patent.

One end of the lower lever 19 is pivotally connected to a latch plunger 120 by a pivot pin 21 as more particularly shown and described in the aforesaid Wilder et al patent. The other end of the lower lever 19 is pivotally connected through a rivet 22 to an upper lever 23 of the handle 16 and a trigger 24.

Figure 8:
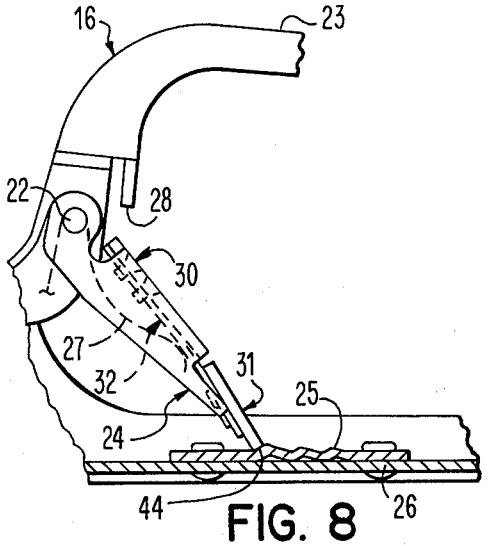
FIG. 8 is a fragmentary side elevation view, partly in section, of the trigger of FIG. 2 and a portion of a handle with the trigger engaging the retaining means to hold the handle in its valve opening position and the flexibility of the trigger at its maximum and exaggerated.

When the handle 16 is pivoted about the pivot pin 21, the trigger 24 is moved into engagement with a notch or step of a rack 25 on a guard 26, which is mounted on the body 10. This engagement of the trigger 24 with the rack 25 is shown in FIG. 8. A spring 27 continuously urges the trigger 24 out of engagement with the step or notch in the rack 25 and into engagement with a stop or projection 28 on the upper lever 23 of the handle 16.

Figure 2:
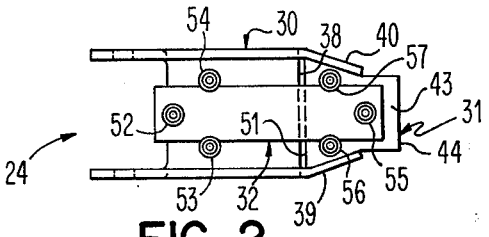
FIG. 2 is a bottom plan view of the trigger of FIG. 1.

As shown in FIG. 2, the trigger 24 includes a body 30, an end piece 31, and a spring 32. the spring 32 connects the body 30 and the end piece 31 to each other and forms flexible means for flexing the trigger 24 when the trigger 24 is engaged with the rack 25 and causing removal of the trigger 24 from the rack 25 when the trigger 24 is subjected to a force beyond a predetermined amount to increase the flexing of the spring 32 whereby this increased flexing is sufficient to reduce the friction between the trigger 24 and the rack 25 after the force beyond the predetermined amount is removed.

Figure 3:
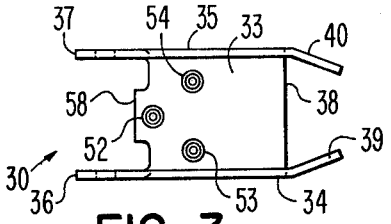
FIG. 3 is a bottom plan view of a body of the trigger of FIG. 2.
Figure 4:
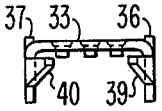
FIG. 4 is an end elevational view of the body of FIG. 3 and taken from the right hand end of FIG. 3.

As shown in FIG. 3, the body 30 includes a central portion 33 having side walls 34 and 35 extending therefrom. The side walls 34 and 35 have ears 36 and 37, respectively. The ears 36 and 37 are disposed on opposite sides of the bifurcated portion of the lower lever 19 and receive the rivet 22 therethrough to pivotally mount the trigger 24 on the handle 16.

Figure 5:
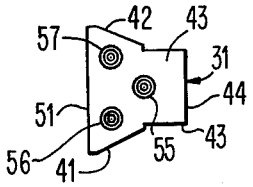
FIG. 5 is a bottom plan view of an end piece of the trigger of FIG. 2.
Figure 6:
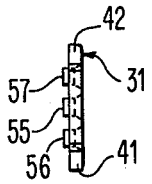
FIG. 6 is an end elevational view of the end piece of FIG. 5 and taken from the right hasn end of FIG. 5.

At the termination of the central portion 33 at its end 38 remote from the ears 36 and 37, the side walls 34 and 35 have inwardly extending end portions 39 and 40, respectively. The end piece 31 has a pair of inclined surfaces 41 and 42 (see FIG. 5) for cooperation with the end portions 39 and 40 of the side walls 34 and 35, respectively, of the body shown in FIG. 2.

The end piece 31 includes a reduced portion 43 extending beyond the end portions 39 and 40 of the side walls 34 and 35, respectively, of the central portion 33 of the trigger 30 as shown in FIG. 2. The reduced portion 43 has its end surface 44 engage a step or notch of the rack 25 as shown in FIG. 8 to hold the handle 16 in any of the valve opening positions in which it is desired for the handle 16 to be disposed in accordance with the desired rate of flow through the nozzle body 10.

Figure 7:
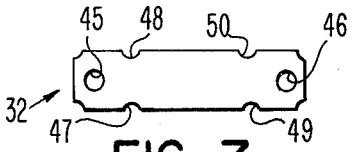
FIG. 7 is a bottom view of a spring of the trigger of FIG. 2.

As shown in FIG. 7, the spring 32, which is a thin, flat element formed of a material having a desired spring rate, has holes 45 and 46 in opposite ends thereof. The spring 32 has notches 47 and 48 on opposite sides thereof adjacent the hole 45 and notches 49 and 50 on opposite sides thereof adjacent the hole 46.

When the end piece 31 is disposed within the body 30 so that the end 38 of the body 30 is adjacent an end 51 of the end piece 31 but slightly spaced therefrom as shown in FIG. 2, the spring 32 is joined to the body 30 and the end piece 31 to connect them to each other. The hole 45 in the spring 32 receives a projection or protrusion 52, which is coined from the central portion 33 of the body 30, and the notches 47 and 48 in the spring 32 are disposed in partial surrounding relation to projection or protrusions 53 and 54, respectively, which also are coined from the central portion 33 of the body 30.

The hole 46 in the spring 32 receives a projection or protrusion 55 of the end piece 31 while the notches 49 and 50 partially surround projections or protrusions 56 and 57, respectively, of the end piece 31. The projections or protrusions 55–57 are coined from the end piece 31.

The projections 52–54 of the central portion 33 of the body 30 are staked to connect the spring 32 to the body 30. Similarly, the projections 55–57 of the end piece 31 are staked to connect the spring 32 to the end piece 31.

The end of the flat spring 32 secured to the central portion 33 of the body 30 lies beneath a tab 58 of the central portion 33 of the body 30. When the trigger 24 is engaging the stop 28 on the upper lever 23 of the handle 16, the tab 58 of the body 30 is the engaging element of the trigger 24.

The end of the spring 32 connected to the end piece 31 terminates prior to the end surface 44 as shown in FIG. 2. However, this end of the spring 32 extends beyond the end of the body 30.

While the flexibility of the spring 32 is exaggerated in FIG. 8 in which the trigger 24 is shown engaging the rack 25, the maximum amount of flexibility between the body 30 and the end piece 31 is limited by the end piece 31 engaging the end portions 39 and 40 of the side walls 34 and 35, respectfully. This keeps the spring 32 from overbending.

If greater force is exerted along the trigger 24 to its engagement with the rack 25 than that produced when the handle 16 had moved the poppet valve 15 to any set flow position, the flexibility of the spring 32 is such that it will flex an additional amount to reduce the friction between the end piece 31 and the rack 25. Thus, when the greater force is no longer produced, this additional flexing causes the end piece 31 to cease to engage the rack 25. This increased force and/or the following instantaneous decreased force and friction would occur if the nozzle body 10 is dropped and strikes the ground, for example, with the handle 16 held by the trigger 24 in an open position. When this occurs, the flexibility of the spring 32 flexes the end piece 31 sufficiently relative to the body 30 to release the end piece 31 from engagement with the rack 25 because there is not a sufficient force acting on the line of action to retain the end piece 31 in engagement with the rack 25.

As soon as this happens, the spring 27 pivots the trigger 24 counterclockwise to the position of FIG. 1 in which the trigger 24 engages the stop 28 on the upper lever 23 of the handle 16. This release of the trigger 24 enables the spring 18 to move the poppet valve 15 to its closed position.

If the tank being filled reaches the level at which the latch plunger 20 is released because of the tank being filled in the manner more particularly shown and described in the aforesaid Wilder patent, then the lower lever 19 pivots counterclockwise about the rivet 22 due to the downward motion of the stem 17. When the trigger 24 ceases to have sufficient force exerted thereon so that the trigger 24 no longer has sufficient frictional engagement with the notch or step of the rack 25 to remain engaged therewith the spring 27 pivots the trigger 24 counterclockwise until the tab 58 on the central portion 33 of the body 30 of the trigger 24 engages the stop 28 on the upper lever 23 of the handle 16.

When the trigger 24 has the end piece 31 released from the notch or step of the rack 25, the handle 16 falls. As a result, the latch plunger 20 is returned to its initial position by its spring as more particularly shown and described in the aforesaid Wilder patent. This results in the lower lever 19 being returned to the position of FIG. 1 as more specifically described in the aforesaid Wilder patent.

Figure 9:
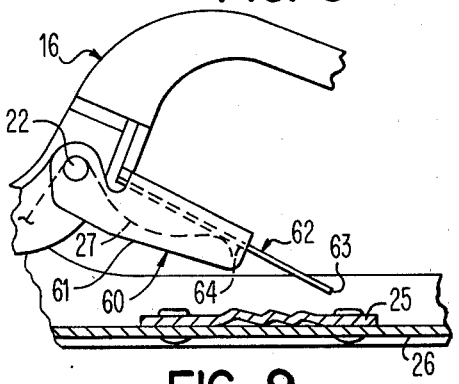
FIG. 9 is a fragmentary elevational view, partly in section, of another embodiment of the trigger with a portion of a handle and showing the trigger in its inactive position.
Figure 10:
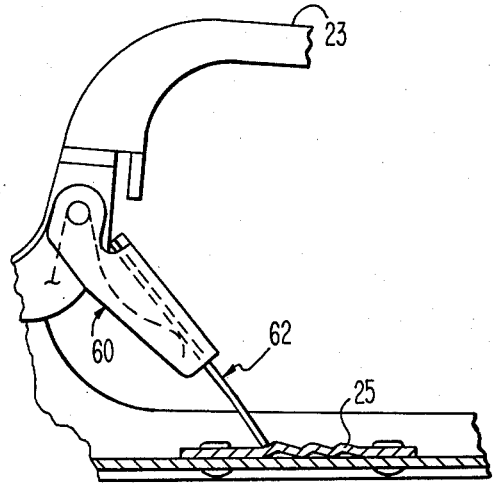
FIG. 10 is a fragmentary elevational view, partly in section, similar to FIG. 9, but showing the trigger of FIG. 9 in its retaining position in which it holds the handle in its valve opening position with the flexibility of the trigger exaggerated.

Referring to FIGS. 9 and 10, there is shown a trigger 60 pivotally mounted on the trigger 16 by the rivet 22. The trigger 60 has a body 61, which is similar to the body 30 except that is does not have the end portions 39 and 40 of the side walls 34 and 35, respectively. Instead, the body 61 terminates at an end corresponding to the end 38 of the body 30.

The trigger 60 has an end piece 62, which has at least its end surface 63 substantially the same width as the distance between the side walls of the body 61. The end piece 62 has a reduced portion 64 of the same width as the spring 32 and has a hole and two notches corresponding to the hole 45 and the notches 47 and 48 of the spring 32 for cooperation with projections or protrusions of the body 61 similar to the projections or protrusions 52–54 of the body 30.

The end surfaces 63 of the end piece 62 is formed of a hardened material while at least the reduced portion 64 of the end piece 62 is formed of a resilient material so that the end piece 62 flexes (see FIG. 10) when the end surface 63 of the end piece 62 engages a step or notch of the rack 25.

Thus, the trigger 60 is substantially similar to the trigger 24 except that it is formed in two pieces rather than three pieces. The operation of the trigger 60 is the same as that shown and described for the trigger 24.

Figure 11:
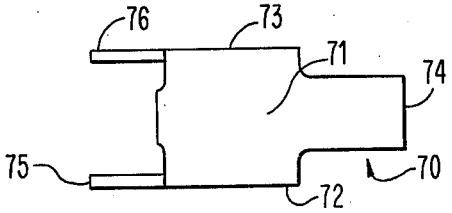
FIG. 11 is a top plan view of a further modification of the trigger of the present invention.
Figure 12:
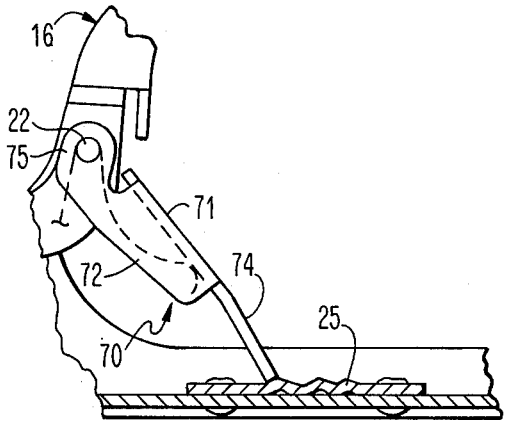
FIG. 12 is a fragmentary elevational view, partly in section, of the trigger of FIG. 11 and showing it in the position in which is holds the handle in its valve opening position with the flexibility of the trigger exaggerated.

Referring to FIGS. 11 and 12, there is shown a trigger 70 pivotally mounted on the handle 16 by the rivet 22. The trigger 70 is a single body formed of a suitable flexible material such as the plastic sold as Delrin, for example.

The trigger 70 includes a central portion 71 (see FIG. 11) having side walls 72 and 73 and a reduced end portion 74 for engaging the rack 25. The side walls 72 and 73 have ears 75 and 76, respectifully, thereon to receive the rivets 22.

When the end portion 74 engages one of the notches or steps in the rack 25, the lower 16 is held in the desired position in which the valve 15 is moved to one of its open positions. If a force greater than that produced by the spring 18 through the valve 15 and the lower 16 occurs because of dropping of the nozzle body 10 and the nozzle body 10 striking the ground, for example, then there is additional flexing of the trigger 70. This flexing absorbs the energy from the nozzle body striking the ground to cause the elements of the nozzle body 10 to tend to jam together. When the nozzle body 10 bounces from the ground, the reduced friction between the end portion 74 and the step or notch in the rack 25 because of the flexing of the trigger 70 is sufficient to cause the end portion 74 to cease to engage the step or notch in the rack 25.

The remainder of the operation of the trigger 70 is the same single element having the necessary flexibility while still transmitting sufficient force to retain the handle 16 in a desired position.

Figure 13:
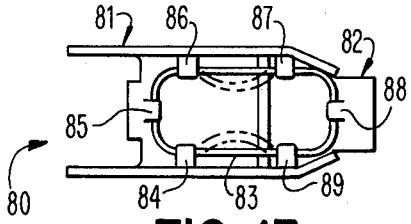
FIG. 13 is a bottom plan view of still another embodiment of the trigger of the present invention.

Referring to FIG. 13, there is shown a trigger 80, which is similar to the trigger 24. The trigger 80 includes a body 81, an end piece 82, and a spring 83. The spring 83 connects the body 81 and the end piece 82 to each other and forms means for flexing the trigger 80 when the trigger 80 is engaged with the rack 25 of FIG. 2 and causes removal of the trigger 80 from the rack 25 when the trigger 80 is subjected to force beyond a predetermined amount and/or the following instantaneous decreased force and friction caused by bouncing of the nozzle body 10 allows the end of the trigger 80 to return the normally straight position of the trigger 80.

As shown in FIG. 13, the body 81 of the trigger 80 is similar to the body 30 of the trigger 24 except that it does not have the projections or protrusions 52–54. Instead, the body 81 has tabs 84, 85, and 86 to retain a portion of the spring 83.

The end piece 82 of the trigger 80 is similar to the end piece 31 of the trigger 24 except that it does not have the protrusions or projections 55–57. Instead, the end piece 82 has tabs 87, 88, and 89 to retain other portions of the spring 83.

When the end piece 82 is disposed in one of the notches or steps of the rack 25 of FIG. 1, for example, the spring 83 bows inwardly as indicated in phantom lines. If the nozzle body 10 is dropped and strikes the ground, for example, with the handle 16 held by the trigger 80 in an open position, the spring 83 flexes further inwardly to absorb the additional energy from the nozzle body 10 striking the ground. There also may be some flexing of the spring 83 in the same plane as that in which the spring 32 flexes as indicated in FIG. 8.

This increased flexing causes the friction between the end piece 82 and the rack 25 to decrease. Thus, when the nozzle body 10 bounces from the ground after striking it, there is an instantaneous decreased force and friction on the elements of the nozzle body 10 so that the stored energy in the spring 83 caused the end piece 82 to cease to engage the rack 25.

Figure 14:
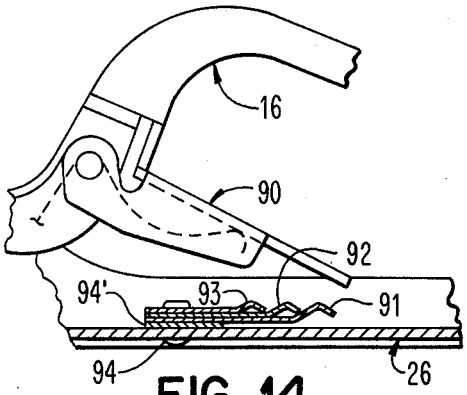
FIG. 14 is a fragmentary side elevational view, partly in section, of still another modification of the retaining arrangement of the present invention in which the retaining means is flexible and showing the trigger in its inactive position.

Referring to FIG. 14, there is shown another form of the present invention. In this modification, the handle 16 has a trigger 90 mounted thereon with the trigger 90 being a non-flexible trigger such as that shown in the aforesaid Wilder et al. patent, for example.

The guard 26, which is mounted on the nozzle body 10 as shown in FIG. 1, has retaining means for the trigger 90. The retaining means comprises a plurality of resilient elements 91, 92, and 93.

Each of the resilient elements 91, 92, and 93 has a rivet 94 attached to one end thereof and to the guard 26 to connect the resilient elements 91–93 to the guard 26. The resilient elements 91–93 are held in spaced relation to the guard 26 by spacer 94.

The resilient element 91 is the lowermost of the three resilient elements, and the resilient element 93 is the uppermost. The lowermost resilient element 91 has the longest length, and the uppermost resilient element 93 has the shortest length.

The free ends of the resilient elements 91–93 are bent upwardly to form steps of notches to receive the free end of the trigger 90. Thus, when the trigger 90 has its end engaging the resilient element 91, the handle 16 is at the minimum flow position of the three positions in which it can be held. When the end of the trigger 90 engages the resilient element 93, the handle 16 is at its maximum flow position of the three position in which it can be held.

Whenever the trigger 90 engages the resilient element 91, only the resilient element 91 flexes. However, the engagement of the trigger 90 with the resilient element 92 causes both of the resilient elements 91 and 92 to flex. The engagement of the trigger 90 with the resilient element 93 causes all of the three resilient elements 91–93 to flex to provide a greater spring force.

If the nozzle body 10 utilizing the embodiment of FIG. 14 should be dropped, the guard 26 tries to move toward the trigger 90 since the portions tend to jam together so that the resilient element 91 is flexed closer to the guard 26 to absorb additional energy. When the nozzle body 10 bounces after striking the ground so that the guard 26 and the trigger 90 return to their initial positions by moving away from each other, the additional energy stored in the resilient element 91 causes it to be further away from the end of the trigger 90. This results in the trigger 90 ceasing to be in engagement with the resilient element 91.

Figure 15:
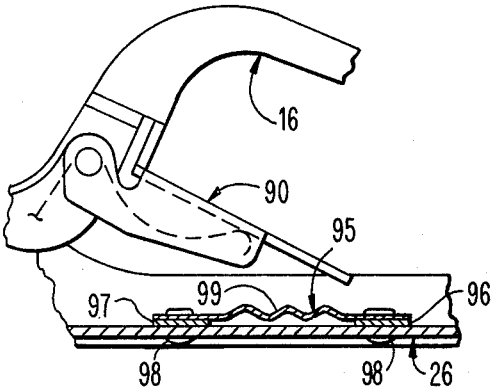
FIG. 15 is a fragmentary side elevational view, partly in section, of a further embodiment of the retaining arrangement of the present invention in which the retaining means is flexible and showing the trigger in its inactive position.

Referring to FIG. 15, there is shown a different arrangement for retaining the trigger 90 than that shown in FIG. 14. In this modification, a single resilient element 95 is disposed in spaced relation to the guard 26 so that the element 95 can flex relatively to the guard 26. Spacers 96 and 97 are disposed at each end of the resilient element 95 to hold it in spaced relation to the guard 26. Rivets 98 secure the spacers 96 and 97 and the ends of the resilient element 95 to the guard 26. The resilient element 95 has steps or notches 99 formed therein to receive the end of the trigger 90 to hold the handle 16 in its various flow positions.

If the nozzle body is dropped, the guard 26 tends to move upwardly toward the handle 16 whereby the resilient element 95 moves downwardly relatively to the guard 26. As a result of this increased flexing of the resilient element 95, the resilient element 95 stores additional energy. This results in the trigger 90 being released from the notch 99 of the resilient element 95 when the guard 26 returns to its initial position because of the nozzle body 10 bouncing after striking the ground, for example.

While the triggers of the present invention have been shown as mounted on the handle 16 and the various retaining means of the present invention mounted on the guard 26, it should be understood that such is not necessary for satisfactory operation. Thus, any of the triggers of the present invention could be pivotally mounted on the guard 26 and any of the retaining means of the present invention mounted on the handle 16 if desired.

An advantage of this invention is that it insures the flow through a nozzle body stops if the nozzle body is accidentally dropped or otherwise struck with sufficient force.

For purposes of exemplification, particular embodiments of the invention have been shown and described according to the best present understanding thereof. However, it will be apparent that changes and modifications thereof may be resorted to without departing from the spirit and scope of the invention.

What is claimed is:

1. A liquid dispensing nozzle comprising a body, valve means in said body to control flow therethrough, means to actuate said valve means to move said valve means to its open position, trigger means pivotally connected to one of said actuating means and said body, retaining means supported by the other of said actuating means and said body and cooperating with the end of said trigger means remote from its pivotal connection to enable said trigger means to hold said actuating means in a position in which said valve means is open, means acting on said trigger means to continuously urge the remote end of said trigger means out of engagement with said retaining means, and at least one of said trigger means and said retaining means including flexible means to cause flexure of at least the one of said retaining means and said trigger means when the remote end of said trigger means engages said retaining means.

2. The nozzle according to claim 1 in which said trigger means includes a body pivotally connected to said actuating means, an end piece for engaging said retaining means, and means connecting said body to said end piece, said connecting means comprising said flexible means and moving said end piece relative to said body when said end piece engages said retaining means.

3. The nozzle according to claim 2 in which said connecting means comprises spring.

4. The nozzle according to claim 3 in which said body includes means to limit the movement of said end piece relative to said body when said end piece engages said retaining means.

5. The nozzle according to claim 2 in which said body includes means to limit the movement of said end piece relative to said body when said end piece engages said retaining means.

6. The nozzle according to claim 1 in which said trigger means includes a first member pivotally connected to said actuating means, a second member secured to said first member and having an end engage said retaining means, and said second member having a portion thereof formed of a flexible material to comprise said flexible means.

7. The nozzle according to claim 1 in which said trigger means includes a body, said body having at least a portion thereof formed of a flexible material to comprise said flexible means.

8. The nozzle according to claim 1 in which said trigger means includes a body formed of a flexible material to comprise said flexible means.

9. The nozzle according to claim 1 in which said retaining means includes resilient means spaced from the other of said actuating means and said body on which said retaining means is supported, said resilient means comprises said flexible means.

10. The nozzle according to claim 9 in which said resilient means of said retaining means comprises a plurality of resilient elements disposed in spaced relation from each other, each of said resilient elements has a different length with said resilient element furtherest from the remote end of said trigger having the longest length.

11. The nozzle according to claim 9 in which said resilient means of said retaining means comprises a single resilient element disposed in spaced relation to the other of said actuating means and said body and having its ends secured thereto.

12. The nozzle according to claim 1 in which said trigger means is pivotally connected to said actuating means and said retaining means is supported by said body.

13. The nozzle according to claim 12 in which only said trigger means includes said flexible means.

14. The nozzle according to claim 12 in which only said retaining means includes said flexible means.

15. The nozzle according to claim 1 in which only said trigger means includes said flexible means.

16. The nozzle according to claim 1 in which only said retaining means includes said flexible means.

* * * * *